United States Patent [19]

Nobbe

[11] 4,119,691

[45] Oct. 10, 1978

[54] METHOD AND MOLD FOR PRODUCING CONCRETE SLOTTED FLOOR

[76] Inventor: Paul J. Nobbe, R.R. 2, Brookville, Ind. 47012

[21] Appl. No.: 763,844

[22] Filed: Jan. 31, 1977

Related U.S. Application Data

[60] Continuation of Ser. No. 542,167, Jan. 20, 1975, abandoned, which is a division of Ser. No. 457,068, Apr. 1, 1974, Pat. No. 3,915,422.

[51] Int. Cl.[2] ..... B28B 1/08

[52] U.S. Cl. ..... 264/71; 249/60; 264/334

[58] Field of Search ..... 264/71, 72, 334, 336; 249/60, 64, 176, 177, 162

[56] References Cited

U.S. PATENT DOCUMENTS

| | | | |
|---|---|---|---|
| 1,458,054 | 6/1923 | Hemphill | 249/64 |
| 1,460,232 | 6/1923 | Ditto | 249/60 |
| 1,911,720 | 5/1933 | Sherman | 249/142 X |

*Primary Examiner*—Thomas P. Pavelko

*Attorney, Agent, or Firm*—Woodard, Weikart, Emhardt & Naughton

[57] ABSTRACT

A method and mold for producing a concrete slotted floor for supporting animals. The mold includes a bottom part with a smooth top surface with lengthwise extending ridges formed thereon. The top part of the mold locks to the bottom part and includes a plurality of parallel slab separators seatable upon the ridges. The top part includes end walls and side walls defining an enclosure for receiving the poured concrete. The slab separators are spaced apart from the end walls allowing the concrete to extend completely around each separator to form integrally joined concrete slabs. Concrete is poured into the top part of the mold between each separator and across the ends of the separators. The mold is vibrated and the concrete is allowed to solidify. The top part of the mold is then lifted upwardly and the solidified concrete is removed and turned over in order that the smooth surface of the concrete contacting the bottom part of the mold faces upwardly. Upstanding pins on the bottom part locate the top part of the mold.

2 Claims, 7 Drawing Figures

METHOD AND MOLD FOR PRODUCING CONCRETE SLOTTED FLOOR

This is a continuation of application Ser. No. 542,167, filed Jan. 20, 1975, now abandoned; which is a division of Ser. No. 457,068, filed Apr. 1, 1974, now U.S. Pat. No. 3,915,422.

BACKGROUND OF THE INVENTION

1. Field of the Invention

This invention relates to concrete slotted animal floor construction.

2. Description of the Prior Art

The use of concrete slabs in parallel spaced relationship to form a slotted floor for supporting animals is well known. The slabs are spaced apart to allow for the animal droppings to pass therethrough to a pit or ditch located beneath the floor. Various methods have been used to construct the slotted floor. A common method is to produce the concrete slabs one at a time and then to manually space the slabs apart. The slabs are then mortised together so as to form a unified construction. The increased labor time and expense required to mortise the slabs together is an undersirable feature of this method. Time is required not only to mortise the slabs together but also to correctly space the slabs apart. The floor structure disclosed in U.S. Pat. No. 3,626,904, issued to Edward J. Hatten, utilizes precast concrete slabs having protrusions formed thereon to allow the slabs to be self-spacing; however, the slabs must still be mortised together. In the U.S. Pat. No. 3,228,376, issued to W. J. Conover, there is disclosed precast concrete slabs which are connected together by metal straps. Two other patents of interest in this field are the U.S. Pat. Nos. 3,360,230, issued to A. B. Clements et al, and 2,275,080, issued to W. Kelly. Disclosed herein is a new method and mold for simultaneously forming a plurality of concrete slabs which are spaced apart but integrally joined together at their opposite ends.

It is desirable for the concrete slabs to have a smooth top surface thereby allowing for the easy removal of the animal droppings from the slabs. In order to obtain the smooth top surface for each slab, it has been the practice to manually smooth the top surface of each slab prior to solidification of the concrete. This smoothing operation increases the labor time required to produce each slab and, as a result, is undesirable due to the increased cost. In the U.S. Pat. No. 3,455,279, issued to R. R. Krevit, the slabs are poured upside down with a rubber pad positioned in the bottom of the mold thereby being attached to the slab allowing for a smooth top surface of the slab when removed from the mold. The Krevit slabs subsequent to solidification are mortised together. A problem with the prior art floor construction is the relatively low strength of long slabs. Long slabs will bow apart intermediate the slab ends thereby allowing the animal, such as a hog, to catch its foot between slabs. The floor construction disclosed herein is provided with center strengthening ribs which prevent the slabs from bowing apart. In addition, metal grids are provided within the floor so as to increase the overall strength of the floor construction.

SUMMARY OF THE INVENTION

One embodiment of the present invention is a method of producing a concrete floor having integrally connected slabs for supporting animals comprising the steps of providing a bottom mold having a smooth top surface extending thereacross, mounting a top mold having longitudinally extending spacers atop the bottom mold so the spacers contact the smooth top surface, placing first metal rods between the spacers, placing second metal rods perpendicular to the first rods and at ends of the spacers, pouring concrete between the spacers to form slabs and across ends of the spacers to integrally join the slabs, allowing the concrete to solidify, lifting the top mold off the bottom mold and removing the solidified concrete from the bottom mold and turning the solidified concrete over so the concrete in contact with the smooth top surface faces upwardly.

Another embodiment of the present invention is a mold for producing a floor with a smooth top surface and having integrally joined concrete slabs for supporting animals cmprising a bottom part with a smooth top surface extending thereacross to form the smooth top surface of the floor, a top part removably mounted atop the bottom part, the top part includes a pair of side walls and end walls connected together forming an enclosure for holding poured concrete, the top part further includes spaced apart slab separators extending in the direction of the side walls, the separators are spaced from the end walls allowing concrete to extend completely around each separator forming the integrally joined concrete slabs, each separator has a bottom end contacting the bottom part and opposite side surfaces diverging from said bottom end.

It is an object of the present invention to provide a new and improved method for producing a concrete slotted floor for supporting animals.

A further object of the present invention is to provide a new and improved mold for producing a concrete slotted floor for supporting animals.

Yet another object of the present invention is to provide a method and mold for producing a concrete floor having integrally joined spaced apart slabs.

Related objects and advantages of the present invention will be apparent from the following description.

DESCRIPTION OF THE PREFERRED EMBODIMENTS

Figure 1:
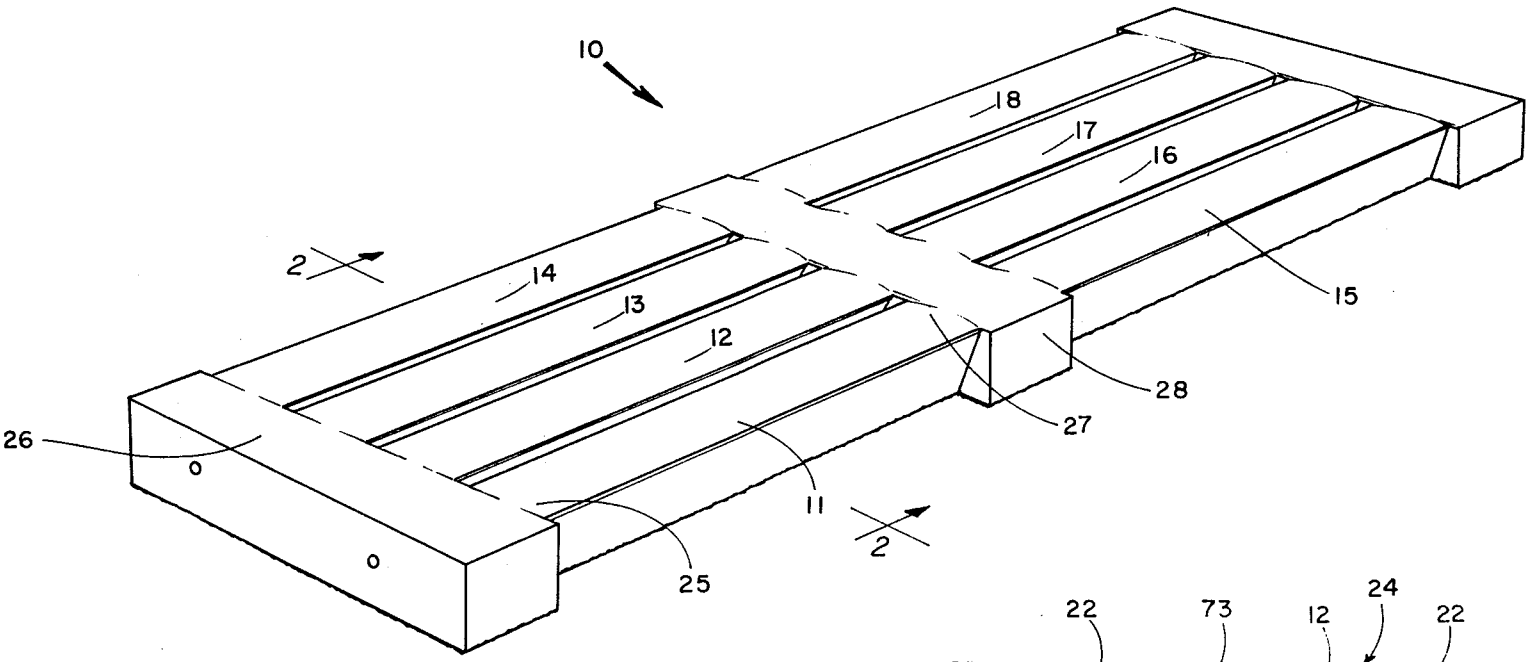
FIG. 1 is a perspective view of a concrete slotted floor produced by the method and mold disclosed herein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a concrete slotted floor 10 for supporting animals. Floor 10 includes four parallel concrete and spaced apart slabs 11 through 14 integrally joined together and integrally joined and aligned with four additional parallel slabs 15 through 18. Slab 11 will now be described it being understood that a similar description applies to the remaining seven slabs.

Slab 11 (FIG. 2) has a rough bottom surface 19 with a pair of diverging side surfaces 20 and 21 extending upwardly therefrom to a convex top surface 22. Surface 20 of slab 11 is spaced apart from surface 23 of slab 12 forming a gap 24 for receiving animal droppings. Gap 24 increases in width from the top surfaces of the slabs to the bottom surfaces of the slabs.

End 25 of slab 11 is integrally joined to slabs 12 through 14 by a concrete cross portion 26. Likewise, end 27 of slab 11 is integrally joined to the opposite ends of slabs 12 through 14 and to the ends of slabs 15 through 18 by concrete cross portion 28.

Figure 3:
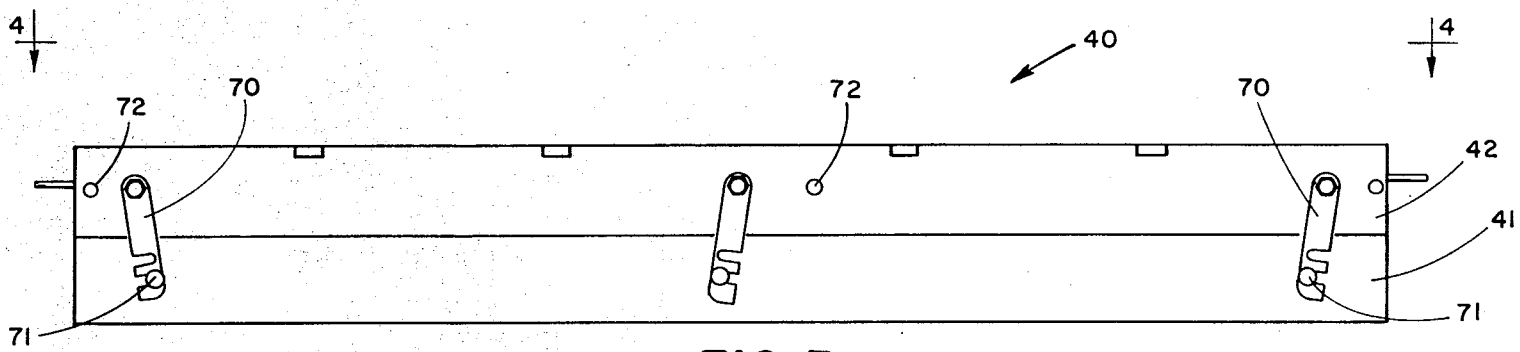
FIG. 3 is a side view of the mold incorporating the present invention and which is used to produce the floor shown in FIG. 1.

Mold 40 (FIG. 3) is used to produce floor 10 and includes a bottom part 41 and a top part 42. Bottom part 41 (FIG. 7) may be produced from concrete within a wood frame with a layer of fiber glass forming a smooth top surface for bottom part 41. Likewise, bottom part 41 (FIG. 7) may be produced entirely from fiber glass 43 within a wood frame 44 with the top surface 45 of bottom part 41 being smooth. The important feature of part 41 is that the top surface 45 be completely smooth for forming the top smooth surface of the slotted floor.

Figure 4:
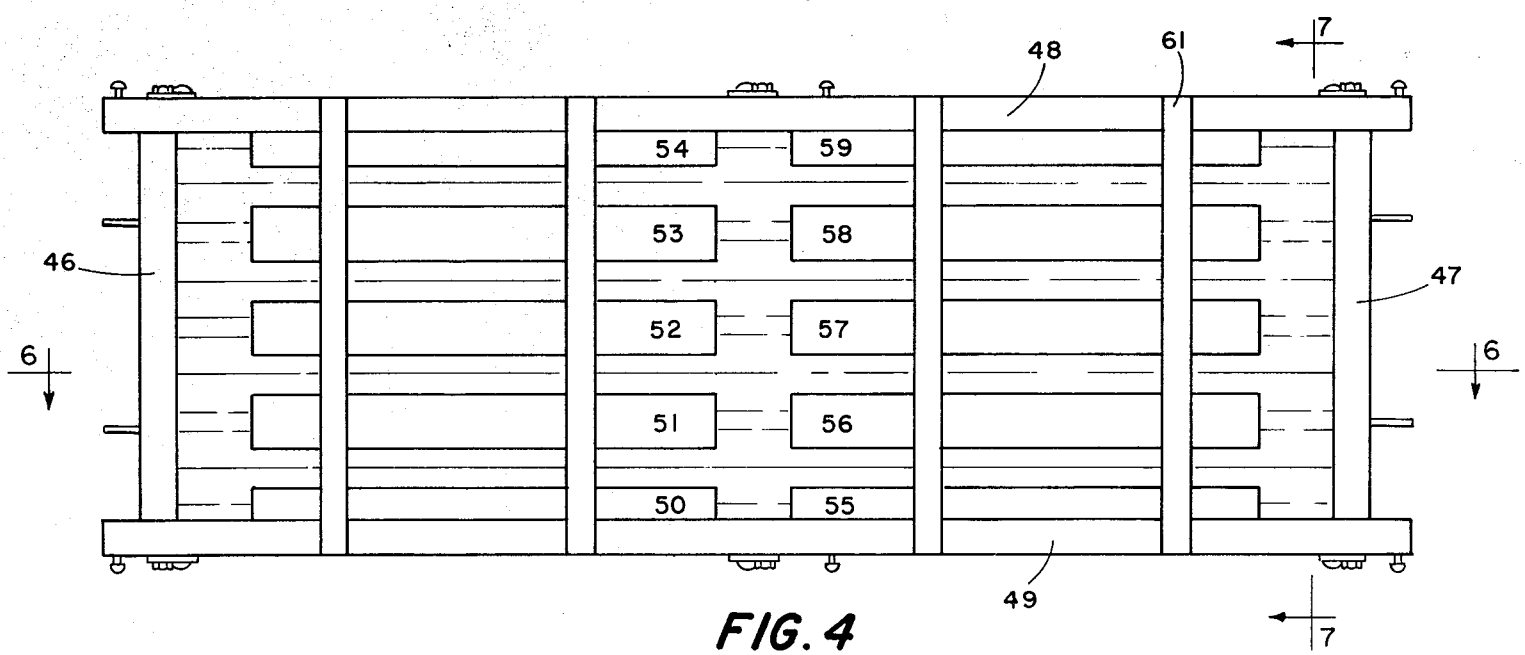
FIG. 4 is a top view of the mold shown in FIG. 3 viewed in the direction of arrows 4—4.

Top part 42 is removably mounted atop bottom part 41 and includes a pair of end walls 46 and 47 (FIG. 4) connected to side walls 48 and 49. Walls 46 through 49 may be produced from wood and form an enclosure for holding poured concrete. A plurality of spaced apart slab separators 50 through 54 are arranged in a first group with additional separators 55 through 59 being arranged in a second group. The separators extend in the direction of side walls 48 and 49 and are spaced from end walls 46 and 47 allowing the poured concrete to fill the slab mold voids between the separators and the cross portion mold voids at the ends of the separators such that the poured concrete completely extends around each separator 51 through 53 and 56 through 58 forming the integrally joined concrete slabs. The mutually facing ends of separators 50 through 54 are spaced apart from separators 55 through 59 and are aligned therewith. All separators are parallel.

Separator 56 will now be described it being understood that a similar description applies to separators 51 through 53 and 57 through 58. Separator 56 (FIG. 7) includes a top end 60 fixedly secured to metal band 61 (FIG. 4) having opposite ends mounted to side walls 48 and 49. The side surfaces 62 and 63 of separator 56 converge downwardly to bottom end 64 which is removably seated atop upraised portion or ridge 65 of bottom part 41. By this arrangement of separators, once the concrete is poured to a level coincident with the uppermost surface of top part 42 and allowed to solidify, gaps 24 will extend completely through slotted floor 10.

Figure 2:
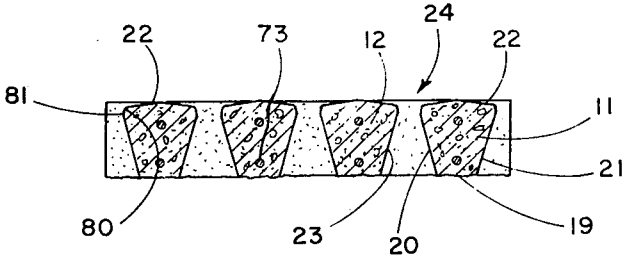
FIG. 2 is a cross-sectional view taken along the line 2—2 of FIG. 1 and viewed in the direction of the arrows.
Figure 7:
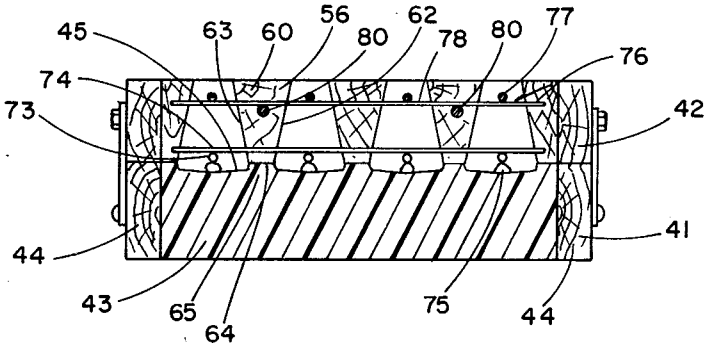
FIG. 7 is a cross-sectional view taken along the line 7—7 of FIG. 4 and viewed in the direction of the arrows.
Figure 5:
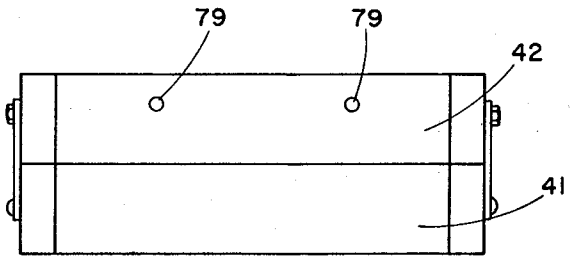
FIG. 5 is an end view of the mold shown in FIG. 4.
Figure 6:
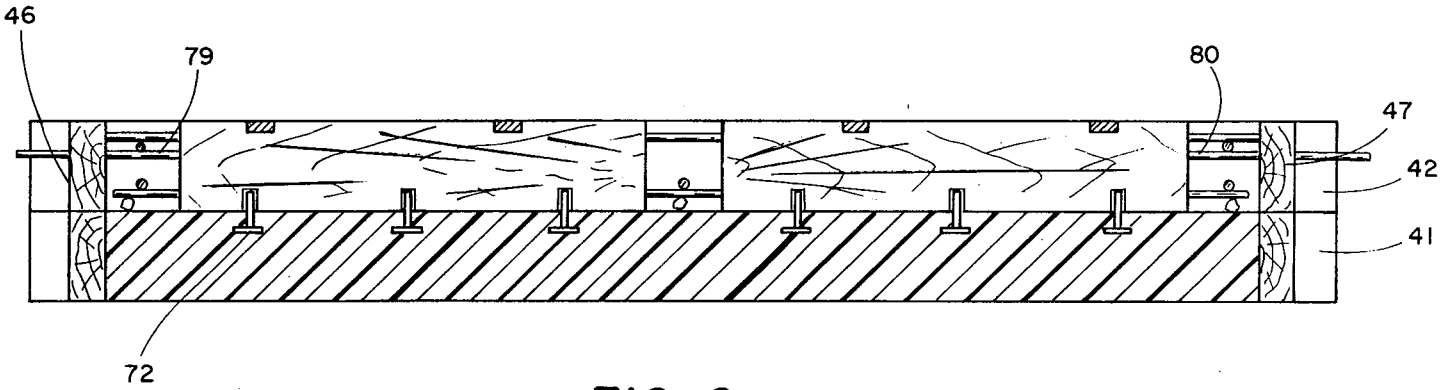
FIG. 6 is a cross-sectional view taken along the line 6—6 of FIG. 4 and viewed in the direction of the arrows.

Bottom part 41 has a plurality of lengthwise extending ridges upon which the separators are seated. The ends of separators 50 through 54 are spaced apart from the ends of separators 55 through 59 allowing the concrete to be poured between the first group of separators and the second group of separators. Separators 50 and 55 are fixedly attached to side wall 49 whereas separators 54 and 59 are attached to side wall 48. As shown in FIG. 7, the top surface of bottom part 41 is concave between the ridges or between the separators thereby providing the convex top surface 22 as shown in FIG. 2 for the concrete slabs.

A plurality of members 70 (FIG. 3) are pivotally mounted to the top part of the mold having a slotted bottom end to slidably receive projections 71 for locking parts 41 and 42 together. Additional projections 72 are provided on part 42 thereby allowing members 70 to be swung upwardly so as to unlock parts 41 and 42 and to rest upon projections 72 when not in use.

As previously discussed, the top surface 45 of bottom part 41 is formed by fiber glass so as to provide a smooth surface. The separators and side and end walls of top part 42 may be produced from wood with bands 61 being metal. A plurality of upstanding pins 72 (FIG. 2) project through ridges 65 and are received by complementary shaped holes provided in the separators thereby locating part 42 with respect to part 41. If desired, pins 72 may be located only on the two outermost ridges.

The method of producing the concrete floor includes providing a bottom mold having a smooth top surface extending thereacross. A metal rod 73 (FIG. 7) is then placed between each separator and extends the length of the mold from end wall 46 to end wall 47. Additional metal rods 74 are then welded perpendicular to rods 73 with rods 74 being positioned between end wall 46 and the ends of separators 50 through 54, between end wall 47 and the ends of separators 55 through 59 and between the mutually facing ends of the first group of separators 50 through 54 and the second group of separators 55 through 59. The resulting metal grid formed is elevated slightly above surface 45 (FIG. 7) by positioning rocks 75 beneath rods 73. A second metal grid 76 is then positioned over the grid formed by rods 73 and 74. Grid 76 includes a plurality of rods 77 positioned between the separators and extending along the lengths of rods 73. Cross metal rods 78 are likewise positioned over rods 74 and are welded to rods 77. Rods 78 are perpendicular to rods 77. Part 42 is the mounted atop part 41 with the upstanding pins 72 projecting into the separators. Members 70 are then locked to projections 71.

The grid 76 formed by rods 77 and 78 is elevated above the grid formed by rods 73 and 74 by inserting rods 79 and 80 through holes extending through end walls 46 and 47. Rods 80 project through end wall 47 and into separators 56 and 58. Likewise, rods 79 project through end wall 46 into separators 51 and 53. The grid formed by rods 76 and 77 is then seated atop rods 79 and 80.

The concrete is then poured into the mold voids so as to completely surround the metal rods as well as the separators and to be flush with the uppermost surface of the top part 42. The mold is then vibrated with the concrete then being allowed to solidify. Rods 79 and 80 are then withdrawn from the mold and the top part 42 is unlocked from the bottom part 41 and removed therefrom. The solidified concrete is lifted from bottom part 41 and turned over so that the surface of concrete in contact with surface 45 faces upwardly. It is permissible for the bottom surface of the slotted floor to be rough and, as a result, it is unnecessary to smooth the uppermost surface of the concrete when the concrete is positioned within the mold.

A problem with the prior art concrete producing molds is that many of the molds break apart on either side of the individually cast slab thereby providing a dirt collecting seam mark extending the length and on the top surface of the slab. Such a seam is not present on slabs produced in accordance with the present invention.

As shown in FIG. 2, the top edges of each slab are formed by a very small radius and a vertically extending downward portion. Radius 80 and vertical surface 81 (FIG. 2) prevents the edges of each slab from being chipped away by the foot of the animal.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A method of producing a concrete floor from a mold having a top section and a bottom section cooperating to form a mold cavity with the floor having integrally connected slats for supporting animals comprising the steps of:

providing the bottom section of said mold having a smooth top surface extending thereacross containing a plurality of elongated, longitudinally extending concave cavities separated by ridges;

providing the top section of said mold including side portions and having downwardly converging, longitudinally extending spacers and side separators positioned outwardly of said spacers on opposite sides of said mold with said spacers, said separators, said side portions and said top section ganged together and mounting said top section simultaneously with said spacers so said spacers rest atop said ridges of said bottom section, said spacers and said separators vertically extending from said ridges to the uppermost surface of said top section and said spacers extending laterally from cavity to cavity covering said ridges except at ends of said spacers, each of said separators having an inwardly facing surface diverging from said spacers as said facing surface extends toward said bottom section of said mold whereby said spacers and said separators in combination with said ridges define a plurality of slat mold voids extending between cross portion mold voids;

pouring concrete between said spacers and into said slat mold voids to form slats and into said cross portion mold voids at the ends of said spacers to integrally join said slats;

filling said mold voids to a level coincident with the uppermost surface of said top section;

vibrating said bottom section and said top section;

allowing said concrete to solidify;

lifting said top section simultaneously with said spacers upwardly in the same direction from and off said bottom section and simultaneously with said side portions and said side separators in same direction allowing said separators and said spacers to move as part of and with said top section;

removing the solidified concrete from said bottom section; and turning the solidified concrete over without said mold so the concrete in contact with said smooth top surface faces upwardly.

2. The method of claim 1 wherein the parting plane of said mold between said top section and said bottom section is substantially coincident with the uppermost surface of said ridges.

* * * * *